US008607714B2

(12) United States Patent
Ramberg

(10) Patent No.: US 8,607,714 B2
(45) Date of Patent: Dec. 17, 2013

(54) SHADE STRUCTURE

(76) Inventor: Charles E. Ramberg, Los Altos, CA (US)

( * ) Notice: Subject to any disclaimer, the term of this patent is extended or adjusted under 35 U.S.C. 154(b) by 89 days.

(21) Appl. No.: 13/275,238

(22) Filed: Oct. 17, 2011

(65) Prior Publication Data

US 2013/0305965 A1 Nov. 21, 2013

Related U.S. Application Data

(60) Provisional application No. 61/393,840, filed on Oct. 15, 2010.

(51) Int. Cl.
*A47B 37/00* (2006.01)

(52) U.S. Cl.
USPC ..... 108/50.12

(58) Field of Classification Search
USPC ..... 108/50.12
See application file for complete search history.

(56) References Cited

U.S. PATENT DOCUMENTS

| | | | | |
|---|---|---|---|---|
| 2,039,805 | A * | 5/1936 | Knight | 108/50.12 |
| 2,559,421 | A * | 7/1951 | Garrett | 248/515 |
| 2,743,146 | A * | 4/1956 | Wheeler | 108/50.12 |
| 2,782,085 | A * | 2/1957 | Natale | 108/94 |
| 3,434,484 | A * | 3/1969 | Dilullo | 135/16 |
| 4,353,659 | A * | 10/1982 | Comte | 403/24 |
| 4,824,108 | A * | 4/1989 | McLean | 473/474 |
| 6,314,891 | B1 * | 11/2001 | Larson | 108/44 |
| 6,842,922 | B2 * | 1/2005 | Smeed | 5/503.1 |
| 7,334,593 | B2 * | 2/2008 | Avery | 135/88.08 |
| 7,926,496 | B2 * | 4/2011 | Young et al. | 135/16 |
| 2006/0272555 | A1 * | 12/2006 | Carter | 108/50.12 |
| 2009/0026809 | A1 * | 1/2009 | Reeb et al. | 297/16.1 |

* cited by examiner

*Primary Examiner* — Hanh V Tran
(74) *Attorney, Agent, or Firm* — Bresbo AB

(57) ABSTRACT

Various aspects provide for disposing an umbrella over a table. In some cases, an umbrella may be coupled to a table. An umbrella may be disposed at a location other than a center of the table, which may provide for improved shelter from weather arriving at an angle (e.g., wind-driven rain, angled sunlight, and the like).

19 Claims, 5 Drawing Sheets

SHADE STRUCTURE

CROSS REFERENCE TO RELATED APPLICATIONS

This application claims the priority benefit of U.S. provisional patent application No. 61/393,840, filed Oct. 15, 2010, the disclosure of which is incorporated by reference herein.

TECHNICAL FIELD

The present invention relates generally to providing shelter from sunlight, weather, and the like.

BACKGROUND

People seated at a table (e.g., picnic table) may desire protection from the sun, rain, snow, and the like (hereinafter: weather). In some cases, weather may descend from directly overhead. In some cases, weather may arrive at the table at an angle. For example, a table may receive sunlight at an angle. Wind-driven rain may fall at an angle. An umbrella may protect people from weather, but an umbrella disposed over a center of a table may not protect the entire table from weather arriving at an angle. Some umbrellas require a stand, which may be heavy and expensive.

SUMMARY OF THE INVENTION

Protecting a table or other surface from weather (e.g., arriving at an angle) may include disposing a protective device (e.g., an umbrella) at a position other than directly overhead a center of the table. Some umbrellas may be shaped in a manner that matches or otherwise complements the shape of a table designed to couple to the umbrella. Some umbrellas may be shaped to match an arrangement of tables. In some embodiments, an umbrella and table are coupled, which may provide for overhead protection without the use of a base or stand for the umbrella. A coupling may attach a mast (e.g., for an umbrella) to a table (e.g., a picnic table), which may stabilize or otherwise affix the umbrella to the table.

A table may comprise a top, a receiver in the top that is configured to receive a mast, a brace, and a coupling configured to removably couple the mast to the brace. In some cases, the receiver includes a hole in the top. The coupling may include lateral, vertical, angular, and/or sliding adjustability, which may provide for positioning an umbrella (e.g., attached to the mast) with respect to the top. A coupling may include a mast attachment to removably hold the mast, a brace attachment to attach the coupling to the brace, and a pivot connecting the mast attachment to the brace attachment. A mast may include a hinge.

DETAILED DESCRIPTION OF THE INVENTION

Figure 1:
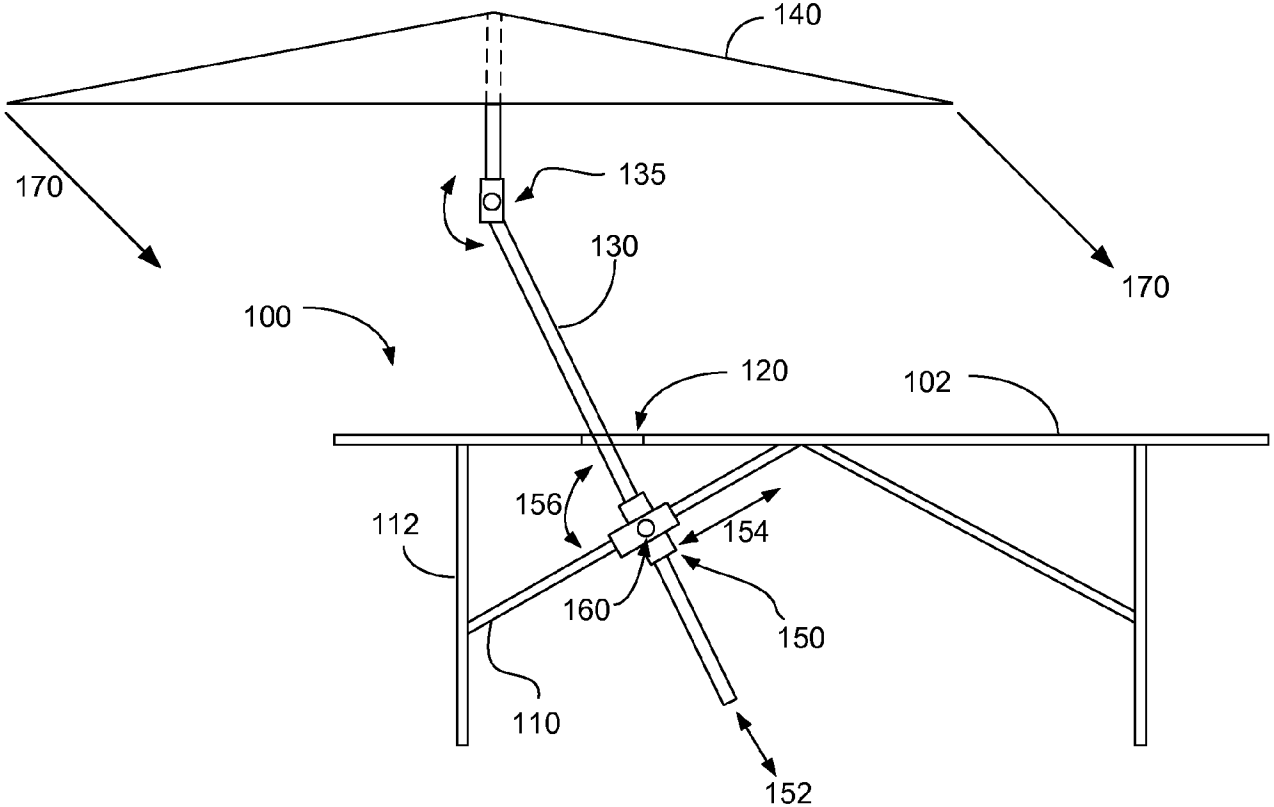
FIG. 1 illustrates an exemplary embodiment.

FIG. 1 illustrates an exemplary embodiment. A table 100 may include a top 102 and a brace 110. Brace 110 may be vertical, horizontal, and/or angled. In some cases, brace 110 may stabilize or otherwise reinforce table 100 (e.g., stabilizing the displacement of a leg 112 with respect to top 102). In some cases, brace 110 may be configured to support an umbrella (e.g., by coupling to a mast of an umbrella). Brace 110 may be straight and/or curved.

Top 102 of table 100 may include one or more receivers 120. A receiver 120 may be configured to couple to an umbrella. In some cases, a receiver 120 may be configured to receive a mast 130 (e.g., of an umbrella 140). Some masts 130 may include a hinge 135, which may provide for changing an angle between umbrella 140 and mast 130.

Receiver 120 may confine or constrain (e.g., vertically, laterally, slidingly, and the like) a displacement of mast 130. In some cases, receiver 120 may vertically and/or horizontally support mast 130. Some receivers may allow mast 130 to slide (e.g., in a direction along the mast, in a direction along the table top, and the like). Some receivers may removably grip mast 130. Receiver 120 may include a hole, which may be sized in at least one dimension to approximately match a diameter of mast 130 (e.g., slightly larger than the diameter). Holes may be round, elliptical, rectangular, curved, or otherwise shaped. In some embodiments, receiver 120 is disposed away from the middle of top 102 (e.g., in a long direction characterizing table 100, and/or along a "width" of table top 102, and the like).

Mast 130 may be coupled or connected to table 100 in a manner that provides for adjusting a position and/or angle of umbrella 140. A coupling may provide for changing an angle between mast 130 and a surface (e.g., top 102) of table 100. In FIG. 1, coupling 150 couples mast 130 to brace 110. Coupling 150 may provide for lateral movement 154 along brace 110. Coupling 150 may provide for "vertical" adjustment (e.g., movement in direction 152) of mast 130. Coupling 150 may include a pivot 160, which may provide for rotation (e.g., changing an angle 156 between mast 130 and brace 110). Pivot 160 may include a freely rotating hinge. Pivot 160 may include a tightening mechanism that affixes mast 130 at a desired angle.

By aligning table 100 appropriately (e.g., with the sun, wind, and the like), and adjusting various apparatus (e.g., varying the position of coupling 150 along brace 110, the height of umbrella 140 (above top 102), and the angle of mast 130 with respect to top 102), umbrella 140 may be positioned to provide for shade or otherwise shelter table 100 from weather arriving at an angle. For example, mast 130 may be oriented toward the sun in a manner that positions umbrella 140 in a position other than directly above table 100, which may increase the protection of top 102 afforded by umbrella 140. In the configuration shown in FIG. 1, top 102 may be shaded from sunlight arriving in direction 170 by positioning mast 130 and umbrella 140 as shown. Configurations may be adapted to changing weather conditions (e.g., time of day, season, wind speed) by adjusting various angles to reposition umbrella 140, and optionally by repositioning table 100 with respect to incident weather. In some configurations, a long dimension of table 100 may be aligned with its own shadow at noon. A relative position of umbrella 140 with respect to the surface (and/or seats) of table 100 may be chosen to maximize the protection of the table by the umbrella. In some embodiments, at least one of coupling 150 and receiver 120 attaches umbrella 140 to table 100, which may eliminate the need for a discrete stand, base, or other apparatus to support mast 130.

Figure 2:
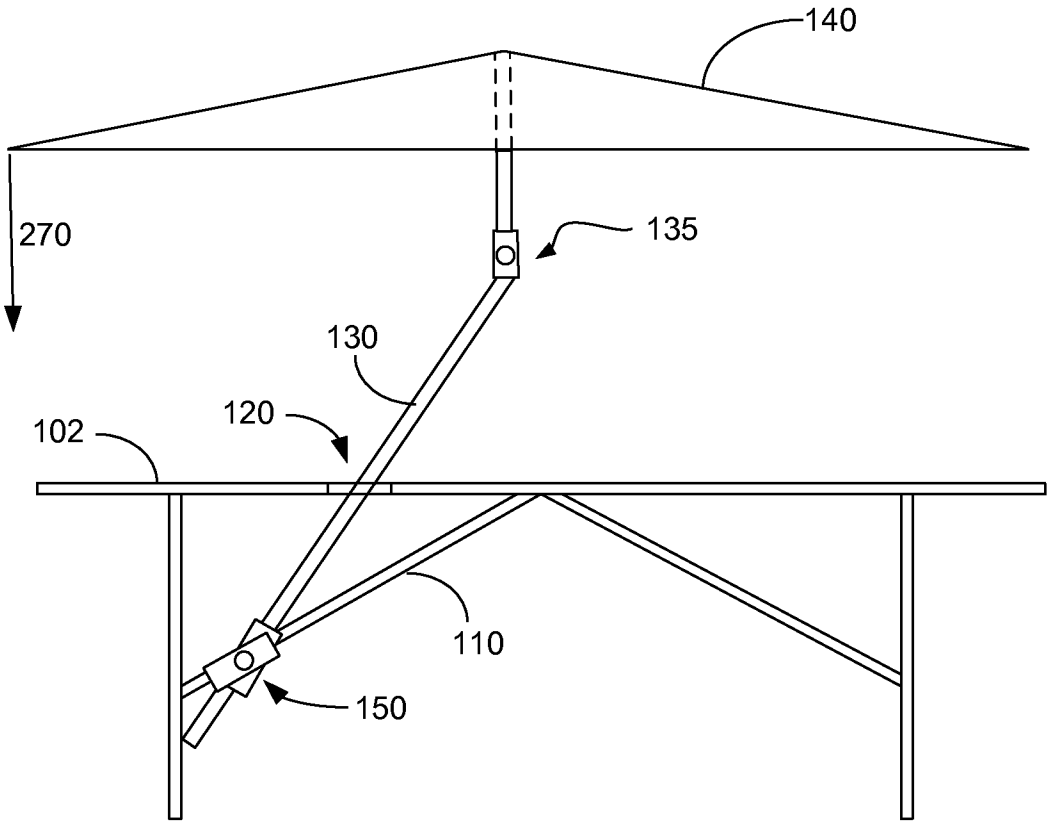
FIG. 2 illustrates a different configuration, according to some embodiments.

FIG. 2 illustrates a different configuration, according to some embodiments. By adjusting (for example) coupling 150 and/or receiver 120, a position of umbrella 140 with respect to table top 102 may be configured as desired. For example, by sliding coupling 150 along brace 110, sliding mast 130 along coupling 150, and adjusting the angle between mast 130 and brace 110, umbrella 140 may be disposed substantially directly above the center of top 102 or away from the center of top 102 as weather conditions require (e.g., overhead for sunlight in direction 270). Adjusting hinge 135 may provide for adapting the orientation of umbrella 140 to a variety of angles between mast 130 and top 102. In some embodiments, a position of receiver 120 may be changed to adjust an angle between mast 130 and top 102.

Figure 3:
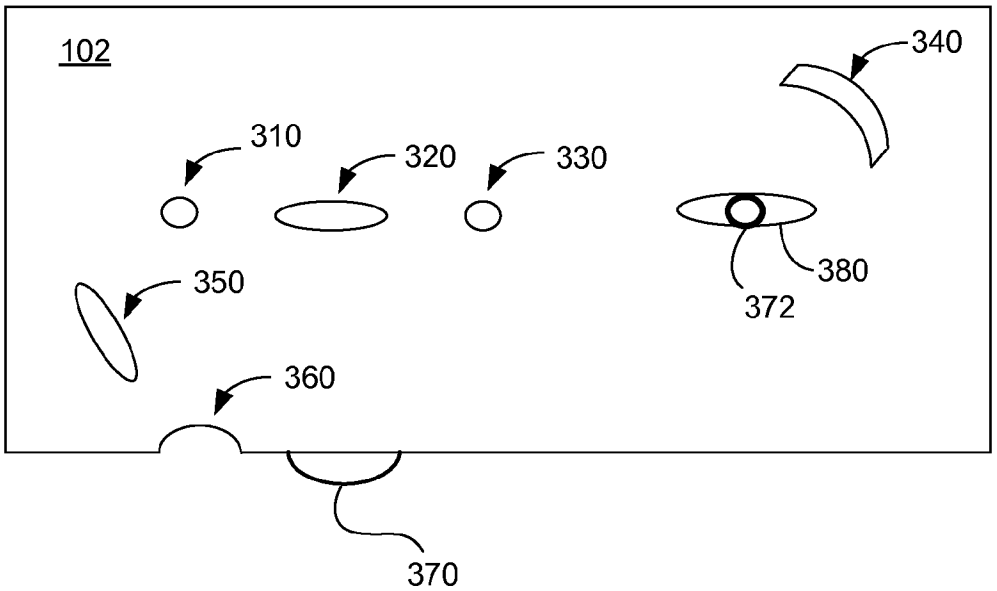
FIG. 3 illustrates several exemplary receivers, according to some embodiments.

FIG. 3 illustrates several exemplary receivers, according to some embodiments. Receiver 310 may include a round hole, and may be disposed away from a center of top 102 (e.g., in the "long" direction of top 102). Receiver 320 may include an elliptical and/or rectangular hole. Receiver 330 may include a hole disposed in a center of top 102. Receiver 340 may include a curved hole. Receiver 350 may include an elongated hole that provides for moving a position of mast 130 (FIG. 1) in both "lengthwise" and "widthwise" directions. Receiver 360 may include a notch or other feature (e.g., at an edge of top 102). Receiver 370 may include a bracket (e.g., a U-shaped bracket). Receiver 380 may include a hole and a clamp 372. Clamp 372 may be adjustable (e.g., to different locations within the hole associated with receiver 380). Clamp 372 may clamp or otherwise affix other apparatus (e.g., mast 130, FIG. 1). A receiver 120 may be offset from a brace (e.g., a brace 110) by a distance, which may be approximately a radius associated with mast 130.

In some embodiments, an actuator (e.g., a motor) may adjust a position of at least one of a mast, receiver, coupling, brace, and umbrella. In some embodiments, a desired position is detected (e.g., an angle of the sun) and an umbrella is adjusted to optimize exposure to (e.g., shading from) weather. A clock may be used to determine a position of the sun. A weather sensor (e.g., wind sensor, photodiode, photovoltaic cell) and the like may be used to determine a desired position. In some embodiments, an umbrella, shade, solar panel and/or other feature (e.g., attached to a mast) may be configured to "track" incoming weather.

Figure 4:
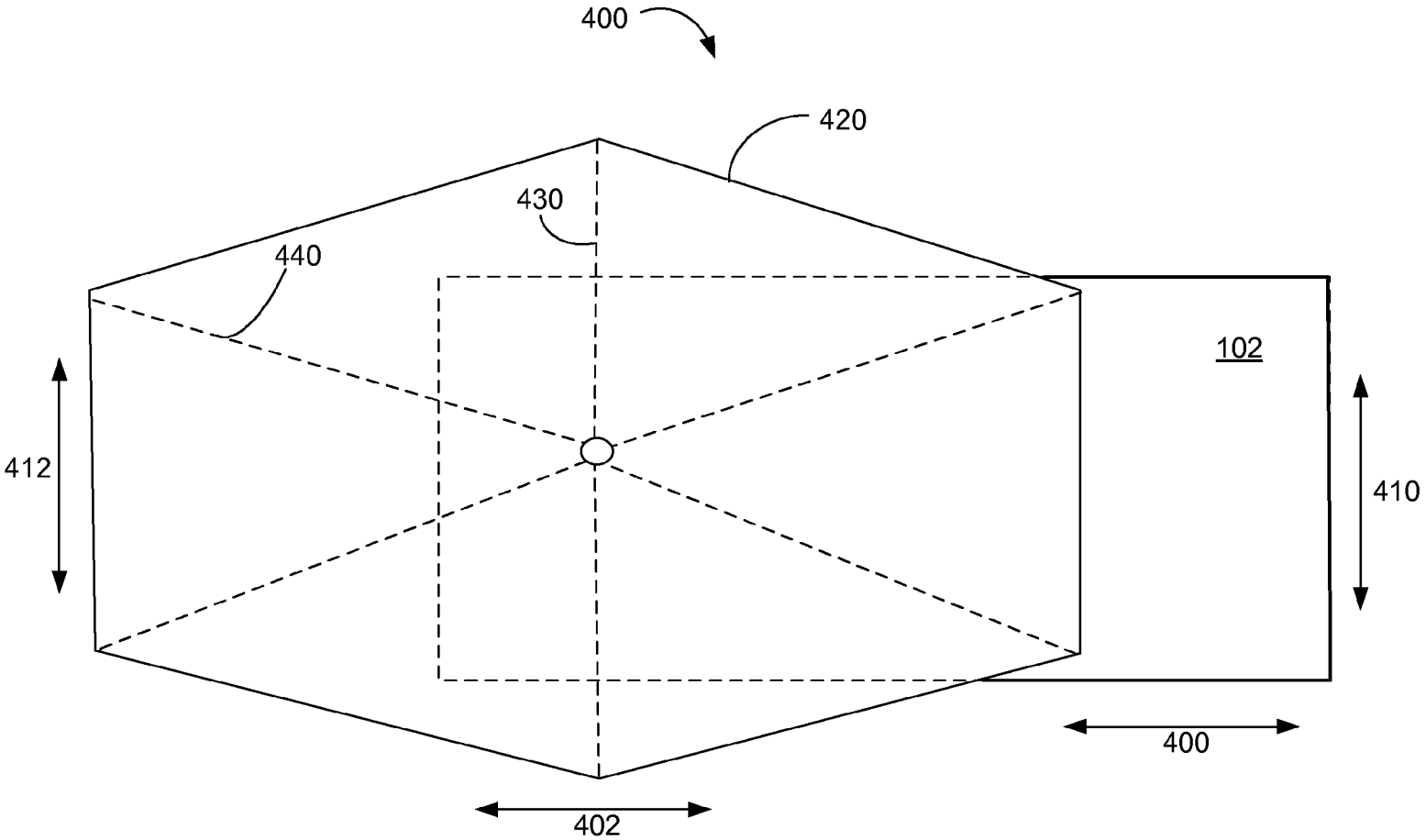
FIG. 4 illustrates an exemplary umbrella and configuration, according to some embodiments.

FIG. 4 illustrates an exemplary umbrella and configuration, according to some embodiments. FIG. 4 illustrates a configuration as viewed from above. Configuration 400 may include an umbrella 420 disposed over a top 102. Umbrella 420 may be positioned (e.g., as in FIG. 4) to shade top 102 from sunlight incipient at an angle (e.g., with the sun on the "left" side of the page).

Top 102 may be longer in a length 400 than in a width 410. Umbrella 420 may be longer in a length 402 than a width 412. Umbrella 420 may include a flexible cover (e.g., canvas), which may be supported by support arms. Umbrella 420 may include a first arm 440 that is longer than a second arm 430. In some embodiments, a shape (e.g., as viewed from above) of an umbrella is similar to the shape of the table with which the umbrella may be used.

Figure 5:
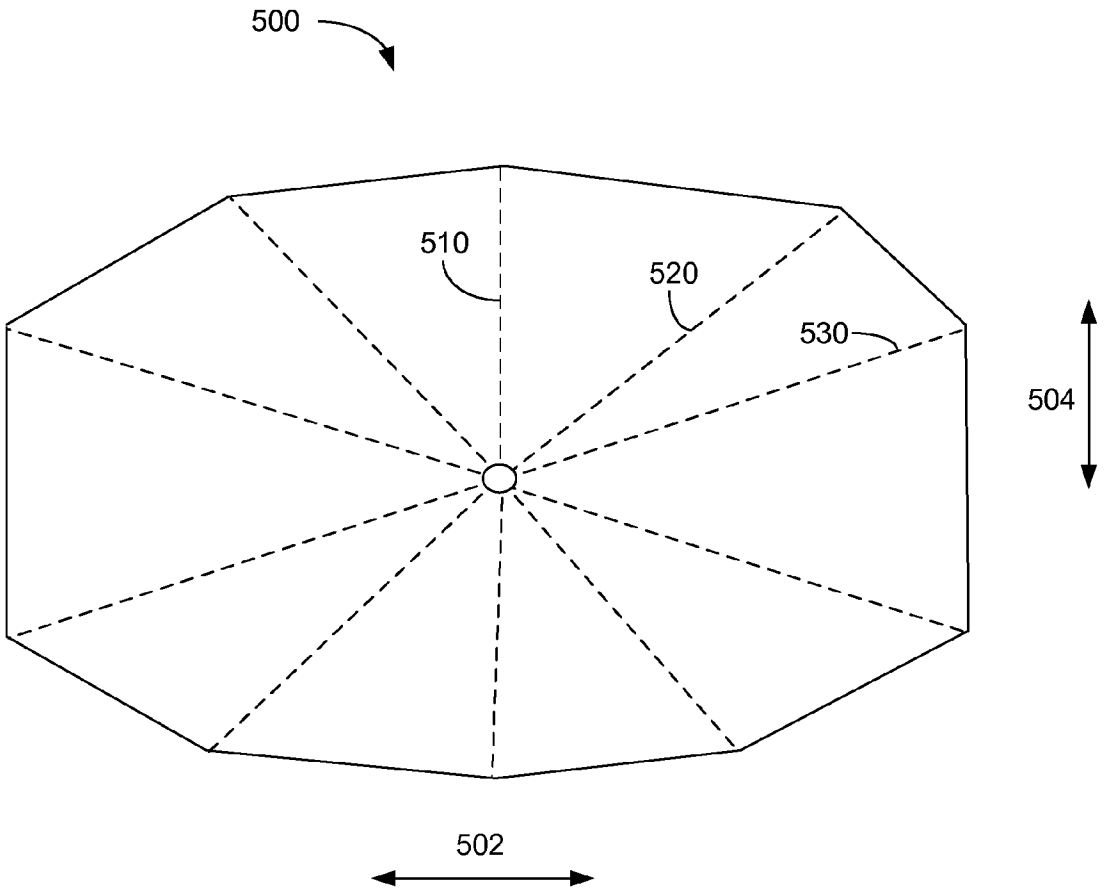
FIG. 5 illustrates an exemplary umbrella, according to some embodiments.

FIG. 5 illustrates an exemplary umbrella, according to some embodiments. Umbrella 500 includes a first arm 510, a second arm 520, and a third arm 530. In some cases, umbrella 500 may be longer in a first direction 502 than in a second direction 504. In some cases, third arm 530 is longer than at least one of, and sometimes both of first arm 510 and second arm 520. In some cases, second arm 520 is longer than at least one of, and sometimes both of, first arm 510 and third arm 530. In some cases, first arm 510 is shorter than second arm 520 and third arm 530, which may be approximately the same length.

The above description is illustrative and not restrictive. Many variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. A table comprising:

a top;

a receiver in the top, the receiver configured to receive a mast;

a brace; and a coupling configured to removably couple the mast to the brace including a mast attachment configured to removably attach to the mast in a manner that provides for adjustment of the mast relative to the mast attachment; and a brace attachment configured to removably attached to the brace in a manner that allows the coupling to slide to different positions along the brace to provide for different angles of the mast with respect to the top.

2. The table of claim 1, wherein the mast comprises a first portion coupled to the brace, and a second portion passing through the receiver, and the receiver includes a hole in the top having a diameter slightly larger than that of the second portion of the mast, and the brace is disposed below the top.

3. The table of claim 1, wherein, at a first angle, an upper portion of the mast is disposed above the top and at a center of the table, and at a second angle, the upper portion of the mast is disposed away from the center of the table.

4. The table of claim 1, wherein the receiver includes a clamp attached to the top.

5. The table of claim 1, wherein the brace stabilizes the top.

6. The table of claim 1, further comprising a leg supporting the top, and the brace is connected to the leg.

7. The table of claim 1, wherein the coupling further includes:

a pivot connecting the mast attachment to the brace attachment.

8. The table of claim 1, wherein the brace includes a tube, and the coupling includes a U-bolt.

9. The table of claim 1, wherein:

the receiver includes a hole in the top disposed a first distance from a center of the top in a horizontal direction;

the brace is connected to at least one of a leg of the table and the top;

the mast includes an upper portion above the top; and the coupling is configurable to provide for an angle that disposes the upper portion of the mast above a center of the top of the table.

10. The table of claim 9, wherein the coupling includes a pivot configured to provide for an adjustment of an angle of the mast with respect to the top.

11. The table of claim 9, wherein the top has a length greater than a width, and the first distance is in a direction along the length of the table.

12. An apparatus comprising:

a table according to claim 1; and an umbrella coupled to an upper portion of the mast above the top.

13. The apparatus of claim 12, wherein the mast includes a hinge between the upper portion and a second portion of the mast.

14. The table of claim 1, wherein the brace is curved, and the receiver constrains the second portion of the mast vertically and laterally.

15. The table of claim 6, wherein the brace is connected to the top, and at least a portion of the brace is disposed at an angle between the top and the leg.

16. The table of claim 1, further comprising an actuator coupled to at least one of the mast, receiver, brace, and coupling, the actuator configured to adjust the angle of the mast with respect to the top.

17. The table of claim 16, wherein the actuator is configured to track incoming weather and to adjust the mast in response to the incoming weather.

18. A coupling comprising:

a mast attachment configured to removably attach to a mast of an umbrella in a manner that allows the mast to slide in a direction aligned with the mast attachment;

a brace attachment configured to removably attach to a brace of a table, the brace connected to at least one of a top of the table and a leg of the table, the brace attachment adjustable in a manner that allows the brace attachment to slide along the brace, and a pivot connecting the mast attachment to the brace attachment, the pivot providing for a plurality of angles between the mast attachment and the brace attachment thereby adjusting the angle of the mast with respect to the top.

19. The coupling of claim 18, further comprising an actuator configured to adjust an angle of the mast with respect to the top.

* * * * *